US008280639B2

(12) United States Patent
Conquergood et al.

(10) Patent No.: US 8,280,639 B2
(45) Date of Patent: Oct. 2, 2012

(54) METHOD AND SYSTEM FOR MONITORING THE EFFICIENCY AND HEALTH OF A HYDRAULICALLY DRIVEN SYSTEM

(75) Inventors: Steve Conquergood, Alberta (CA); David Lord, Midland, TX (US)

(73) Assignee: Key Energy Services, LLC, Houston, TX (US)

( * ) Notice: Subject to any disclaimer, the term of this patent is extended or adjusted under 35 U.S.C. 154(b) by 397 days.

(21) Appl. No.: 12/627,542

(22) Filed: Nov. 30, 2009

(65) Prior Publication Data

US 2010/0138159 A1 Jun. 3, 2010

Related U.S. Application Data

(60) Provisional application No. 61/118,493, filed on Nov. 28, 2008.

(51) Int. Cl.
*G01V 1/40* (2006.01)

(52) U.S. Cl. ..... 702/9

(58) Field of Classification Search ..... 702/9
See application file for complete search history.

(56) References Cited

U.S. PATENT DOCUMENTS

| | | | | |
|---|---|---|---|---|
| 3,142,210 | A | | 7/1964 | Rogers |
| 3,768,573 | A | | 10/1973 | Jennings |
| 3,847,040 | A | | 11/1974 | Bufkin |
| 3,955,662 | A | | 5/1976 | Thackston |
| 3,964,552 | A | | 6/1976 | Slator |
| 3,973,434 | A | | 8/1976 | Smith |
| 4,091,451 | A | | 5/1978 | Weiner et al. |
| 4,106,176 | A | | 8/1978 | Rice et al. |
| 4,176,436 | A | | 12/1979 | McCombs et al. |
| 4,199,032 | A | | 4/1980 | Weiner et al. |
| 4,202,225 | A | * | 5/1980 | Sheldon et al. ..... 81/57.35 |
| 4,208,775 | A | | 6/1980 | McCombs et al. |
| 4,208,919 | A | | 6/1980 | Motsinger |
| 4,210,017 | A | | 7/1980 | Motsinger |
| 4,305,472 | A | | 12/1981 | Brossette |
| 4,365,402 | A | | 12/1982 | McCombs et al. |
| 4,400,785 | A | | 8/1983 | Wallace et al. |
| 4,402,052 | A | | 8/1983 | Stone et al. |
| 4,418,931 | A | | 12/1983 | Howard |
| 4,446,745 | A | | 5/1984 | Stone et al. |

(Continued)

FOREIGN PATENT DOCUMENTS

JP 03-054430 A 3/1991

*Primary Examiner* — Aditya Bhat
(74) *Attorney, Agent, or Firm* — King & Spalding LLP

(57) ABSTRACT

Efficiency of a hydraulically driven system is evaluated by monitoring the change in ratio of output torque to input hydraulic pressure. The hydraulic pressure data is received from a hydraulic sensor. The torque data is received from a load cell receiving a force transmitted to it by a back-up wrench. Filters are applied to the data to obtain peak levels of torque and hydraulic pressure. A ratio is generated for each process associated with a rod or other elongated member based on peak torque and hydraulic pressure levels achieved during the process. The ratio is stored and compared to historical ratios to determine if the ratio has changed more than a predetermined amount over time. A similar evaluation can be achieved by comparing speed generated on the elongated member by the hydraulically driven system to the current level controlling the flow of hydraulic fluid to the hydraulically driven system.

14 Claims, 7 Drawing Sheets

U.S. PATENT DOCUMENTS

| | | | |
|---|---|---|---|
| 4,501,335 | A | 2/1985 | Gann |
| 4,552,041 | A | 11/1985 | Coyle, Sr. |
| 4,578,642 | A | 3/1986 | Moake et al. |
| 4,592,125 | A | 6/1986 | Skene |
| 4,604,724 | A | 8/1986 | Shaginian et al. |
| 4,640,245 | A | 2/1987 | Matsuda et al. |
| 4,679,469 | A | 7/1987 | Coyle, Sr. |
| 4,700,787 | A | 10/1987 | Buck et al. |
| 4,730,254 | A | 3/1988 | Voden, Jr. |
| 4,738,145 | A | 4/1988 | Vincent et al. |
| 4,765,401 | A | 8/1988 | Boyadjieff |
| 4,901,805 | A | 2/1990 | Ali-Zade et al. |
| 4,938,109 | A | 7/1990 | Torres et al. |
| 5,040,827 | A | 8/1991 | DeLange |
| 5,087,177 | A | 2/1992 | Haley et al. |
| 5,099,725 | A | 3/1992 | Bouligny, Jr. et al. |
| RE34,063 | E | 9/1992 | Vincent et al. |
| 5,195,406 | A | 3/1993 | Lindqvist |
| 5,245,265 | A | 9/1993 | Clay |
| 5,335,487 | A | 8/1994 | Murakawa et al. |
| 5,402,688 | A | 4/1995 | Okada et al. |
| 5,502,883 | A | 4/1996 | Ohmi et al. |
| 5,668,328 | A | 9/1997 | Steber et al. |
| 5,711,382 | A | 1/1998 | Hansen et al. |
| 5,823,074 | A | 10/1998 | Ahlstone |
| 5,890,403 | A | 4/1999 | Buck |
| 5,988,299 | A | 11/1999 | Hansen et al. |
| 6,003,412 | A | 12/1999 | Dlask et al. |
| 6,079,490 | A | 6/2000 | Newman |
| 6,209,639 | B1 | 4/2001 | Newman |
| 6,212,763 | B1 | 4/2001 | Newman |
| 6,263,763 | B1 | 7/2001 | Feigel, Jr. et al. |
| 6,276,449 | B1 | 8/2001 | Newman |
| 6,374,706 | B1 | 4/2002 | Newman |
| 6,758,095 | B2 * | 7/2004 | Newman ..... 73/700 |
| 2001/0000550 | A1 | 5/2001 | Newman |

* cited by examiner

METHOD AND SYSTEM FOR MONITORING THE EFFICIENCY AND HEALTH OF A HYDRAULICALLY DRIVEN SYSTEM

STATEMENT OF RELATED PATENT APPLICATION

This non-provisional patent application claims priority under 35 U.S.C. §119 to U.S. Provisional Patent Application No. 61/118,493, titled Method and System for Monitoring the Health of a Tongs System, filed Nov. 28, 2008. This provisional application is hereby fully incorporated herein by reference.

FIELD OF THE INVENTION

The current invention generally relates to assembling threaded sucker rods and tubulars of oil wells and other wells. More specifically, the invention pertains to methods for monitoring operational aspects of a hydraulically driven system to identify efficiency losses prior to a system failure.

BACKGROUND OF THE INVENTION

Oil wells and many other types of wells often comprise a well bore lined with a steel casing. A casing is a string of pipes that are threaded at each end to be interconnected by a series of internally threaded pipe couplings. A lower end of the casing is perforated to allow oil, water, gas, or other targeted fluid to enter the interior of the casing.

Disposed within the casing is another string of pipes interconnected by a series of threaded pipe couplings. This internal string of pipes, known as tubing, has a much smaller diameter than casing. Fluid in the ground passes through the perforations of the casing to enter an annulus between the inner wall of the casing and the outer wall of the tubing. From there, the fluid forces itself through openings in the tubing and then up through the tubing to ground level, provided the fluid is under sufficient pressure.

If the natural fluid pressure is insufficient, a reciprocating piston pump is installed at the bottom of the tubing to force the fluid up the tubing. A reciprocating drive at ground level is coupled to operate the pump's piston by way of a long string of sucker rods that is driven up and down within the interior of the tubing. A string of sucker rods is typically comprised of individual solid rods that are threaded at each end so they can be interconnected by threaded couplings.

Since casings, tubing, and sucker rods often extend thousands of feet, so as to extend the full depth of the well, it is imperative that their respective coupling connections be properly tightened to avoid costly repair and downtime. Couplings for tubulars (i.e., couplings for tubing and casings), and couplings for sucker rods (referred to collectively herein as "rods" or "sucker rods" are usually tightened using a tool known as tongs. Tongs vary in design to suit particular purposes, i.e., tightening tubulars or rods, however, each variety of tongs shares a common purpose of torquing one threaded element relative to another. Tongs typically include a hydraulic motor that delivers a torque to a set of jaws that grip the element or elements being tightened.

Various control methods have been developed in an attempt to ensure that sucker rods are properly tightened. However, properly tightened joints can be difficult to consistently achieve due to numerous rather uncontrollable factors and widely varying specifications of sucker rods. For instance, tubing, casings and sucker rods each serve a different purpose, and so they are each designed with different features having different tightening requirements.

But even within the same family of parts, numerous variations need to be taken into account. With sucker rods, for example, some have tapered threads, and some have straight threads. Some are made of fiberglass, and some are made of steel. Some are one-half inch in diameter, and some are over one inch in diameter. With tubing, some have shoulders, and some do not. Even supposedly identical tongs of the same make and model may have different operating characteristics, due to the tongs having varying degrees of wear on their bearings, gears, or seals. Also, the threads of some sucker rods may be more lubricated than others. Some threads may be new, and others may be worn. These are just a few of the many factors that need to be considered when tightening sucker rods and tubulars.

Furthermore, as tongs system components age, their ability to react consistently is reduced. For example, the amount of energy, in the form of hydraulic pressure, necessary to generate a specific torque on an elongated member by a tongs drive increases over time. Also, the amount of speed generated on an elongated member by a tongs drive based on a constant current level transmitted to the hydraulic valves in the tongs drive system decreases over time as components wear out. Because the system does not react consistently over time, it is difficult to develop a static system that can effectively tighten elongated members over the life of the tongs.

In addition, one main feature of a tongs control system is to be able to make up a rod connection to a specific pre-programmed circumferential displacement based on rod parameters, such as manufacturer, grade, and size. To have the joint connection stop at exactly the correct circumferential displacement value, the controller must issue a "stop" command to the system at a slightly earlier time than desired, to account for the slight delay in system response (electronic component delay, hydraulic component delays, mechanical drive train, rotational inertia). The problem is that this time delay between the stop command being issued and the rod actually stopping is quite short, on the order of 10 milliseconds, and is influenced by changes in temperature. One variation is due to changes in viscosity of the hydraulic fluid. As temperature of the hydraulic fluid increases, viscosity decreases, and the tongs motor is less efficient (conveys less torque, or energy for given flow and pressure). Higher temperatures result in shorter stopping times than when the hydraulic fluid is cold, viscosity is high, and more "sluggish" behavior is seen. Mechanical friction also varies with temperature. This shows up in the response time of the two spools in the hydraulic valve, the tongs motor, and drive mechanism. In this case, hotter temperatures tend to "open up" the devices, and this reduced friction provides faster response times.

Consequently, a need exists in the art for a system and method for evaluating system efficiency in order to know when components are not operating up to acceptable levels. In addition, a need exists in the art for a system and method for monitoring temperature fluctuations both internal and external to the system and modifying the time delay for generating stop signals in order to ensure proper tightening of the rod or other elongated member. Furthermore, a need exists in the art for a system and method for comparing current connection failure levels to historical connection failure levels to determine if improvement has been achieved.

SUMMARY OF THE INVENTION

Efficiency of a hydraulically driven system, such as a tongs system, top drive, or power swivel, can be evaluated over time by monitoring the change in ratio of torque to hydraulic pressure. The hydraulic pressure data can be received from a hydraulic pressure sensor adjacent to the hydraulic motor. The torque data can be determined from a load cell coupled to the tongs system that receives a force transmitted to it by a back-up wrench. Filters can be applied to the data to obtains peak levels of torque and hydraulic pressure. A ratio can be generated for each make-up or breakout of a rod or other elongated member based on the peak torque and hydraulic pressure levels achieved during the make-up or breakout process. The ratio is stored and compared to historical ratios to determine if the ratio has decreased more than a predetermined amount. A similar evaluation can be achieved by comparing speed of the tongs to the current level controlling the flow of hydraulic fluid to the tongs drive system.

For one aspect of the present invention, a method of evaluating the efficiency of a hydraulic system can include receiving multiple hydraulic pressure data points and torque pressure data points during a process for an elongated member. The method can also include selecting one of the hydraulic pressure data points and one of the torque data points generated during the process. A ratio of the selected torque and hydraulic pressure can be generated at a processor. The process can be repeated during additional processes for additional elongated members and the most recent ratio can be compared to the historical ratios to determine if the change in ratio over time is sufficiently large to warrant generating an alarm to the operator.

For another aspect of the present invention, a method for monitoring the efficiency of a hydraulically driven system can include receiving multiple current level data points and speed data points during a process. The current level data points can represent an electrical current level transmitted to a solenoid valve controlling hydraulic pressure generated at the hydraulically driven system. A ratio can be generated comparing the current levels being sent to the PWM valve to speed representing a rotational speed generated on the elongated member. The process can be repeated during additional processes for multiple elongated members and the most recent ratio can be compared to the historical ratios to determine if the change in ratio over time is sufficiently large to warrant generating an alarm to the operator.

In yet another aspect of the present invention, a method for modifying the time delay of a stop signal for a set of tongs during a make-up process can include accepting a baseline expected delay time at the processor. Temperature readings for ambient air and the hydraulic oil driving a hydraulic motor can be collected and a time compensation value can be calculated with the processor based on the temperature readings. The processor can then adjust the expected delay time by the amount of the time compensation value.

These and other aspects, features, and embodiments of the invention will become apparent to a person of ordinary skill in the art upon consideration of the following detailed description of illustrated embodiments exemplifying the best mode for carrying out the invention as presently perceived.

BRIEF DESCRIPTION OF DRAWINGS

For a more complete understanding of the present invention and the advantages thereof, reference is now made to the following description in conjunction with the accompanying figures in which.

Figure 1:
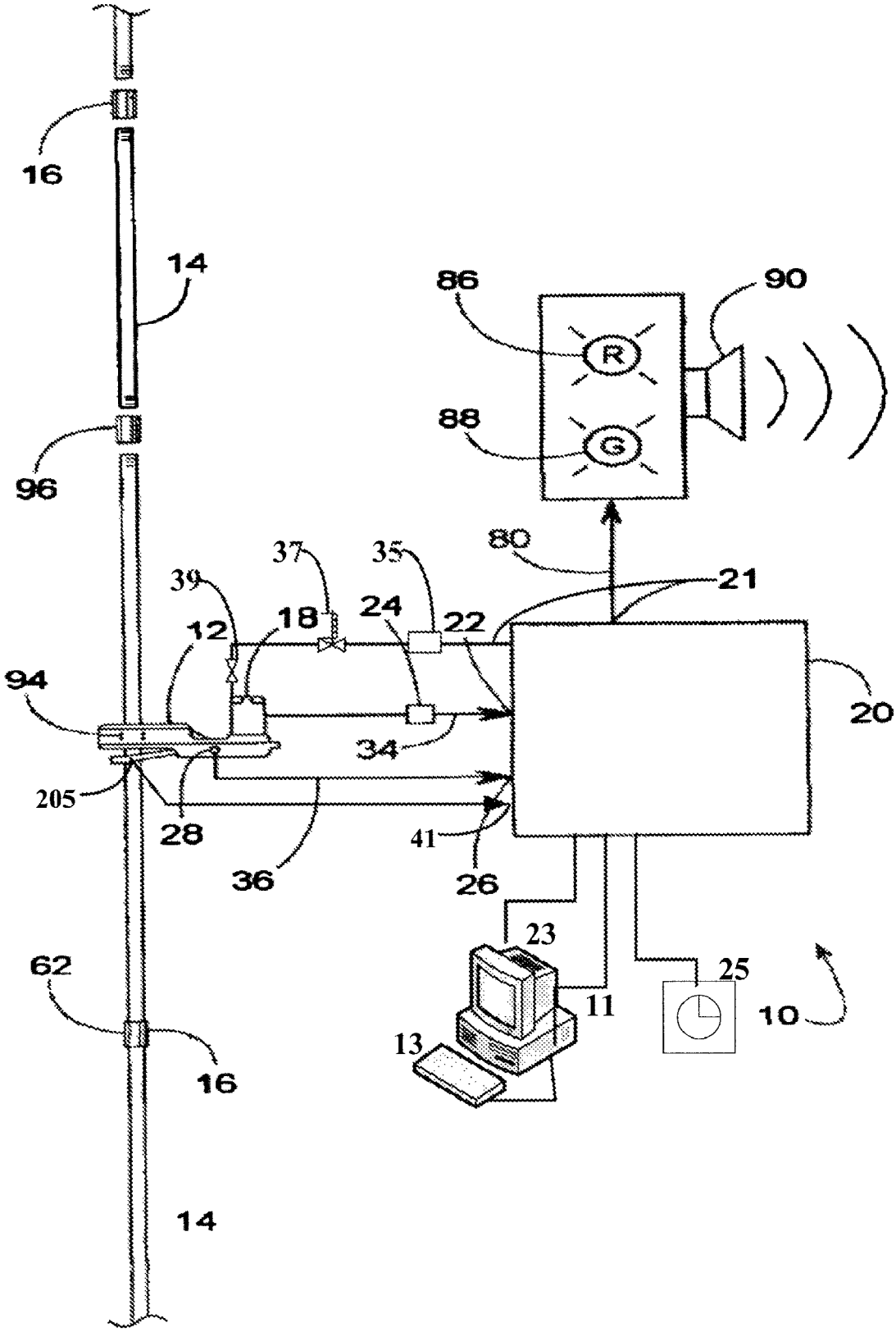
FIG. 1 is a schematic diagram of a system that monitors a set of tongs tightening a string of elongated members according to one exemplary embodiment of the present invention.

Many aspects of the invention can be better understood with reference to the above drawings. The elements and features shown in the drawings are not necessarily to scale, emphasis instead being placed upon clearly illustrating the principles of exemplary embodiments of the present invention. Additionally, certain dimensions may be exaggerated to help visually convey such principles. In the drawings, reference numerals designate like or corresponding, but not necessarily identical, elements throughout the several views.

DETAILED DESCRIPTION OF THE EXEMPLARY EMBODIMENTS

The present invention supports a tongs-based system and methods for monitoring operational aspects of a set of tongs during make-up and breakout to identify efficiency losses prior to a system failure. The present invention further supports modifying operational aspects based on temperature variables during a make-up or breakout process for rods and other elongated members, such at tubulars and other oil well equipment having threaded connections. Exemplary embodiments of the present invention can be more readily understood by reference to the accompanying figures. While the exemplary embodiments described in the figures will be discussed with referent to a make-up process, the same or substantially similar methods could be used to evaluate system performance and modify operational aspects during a breakout process for rods and other elongated members, and such breakout processes are within the scope and spirit of the present invention. The detailed description that follows is represented, in part, in terms of processes and symbolic representations of operations by conventional computing components, including processing units, memory storage devices, display devices, and input devices. These processes and operations may utilize conventional computer components in a distributed computing environment.

Exemplary embodiments of the present invention can include a computer program and/or computer hardware or software that embodies the functions described herein and illustrated in the Figures. It should be apparent that there could be many different ways of implementing the invention in computer programming, including, but not limited to, application specific integrated circuits ("ASIC") and data arrays; however, the invention should not be construed as limited to any one set of the computer program instructions. Furthermore, a skilled programmer would be able to write such a computer program to implement a disclosed embodiment of the present invention without difficulty based, for example, on the Figures and associated description in the application text. Therefore, disclosure of a particular set of program code instructions or database structure is not considered necessary for an adequate understanding of how to make and use the present invention. The inventive functionality will be explained in more detail in the following description and is disclosed in conjunction with the remaining figures.

Figure 1A:
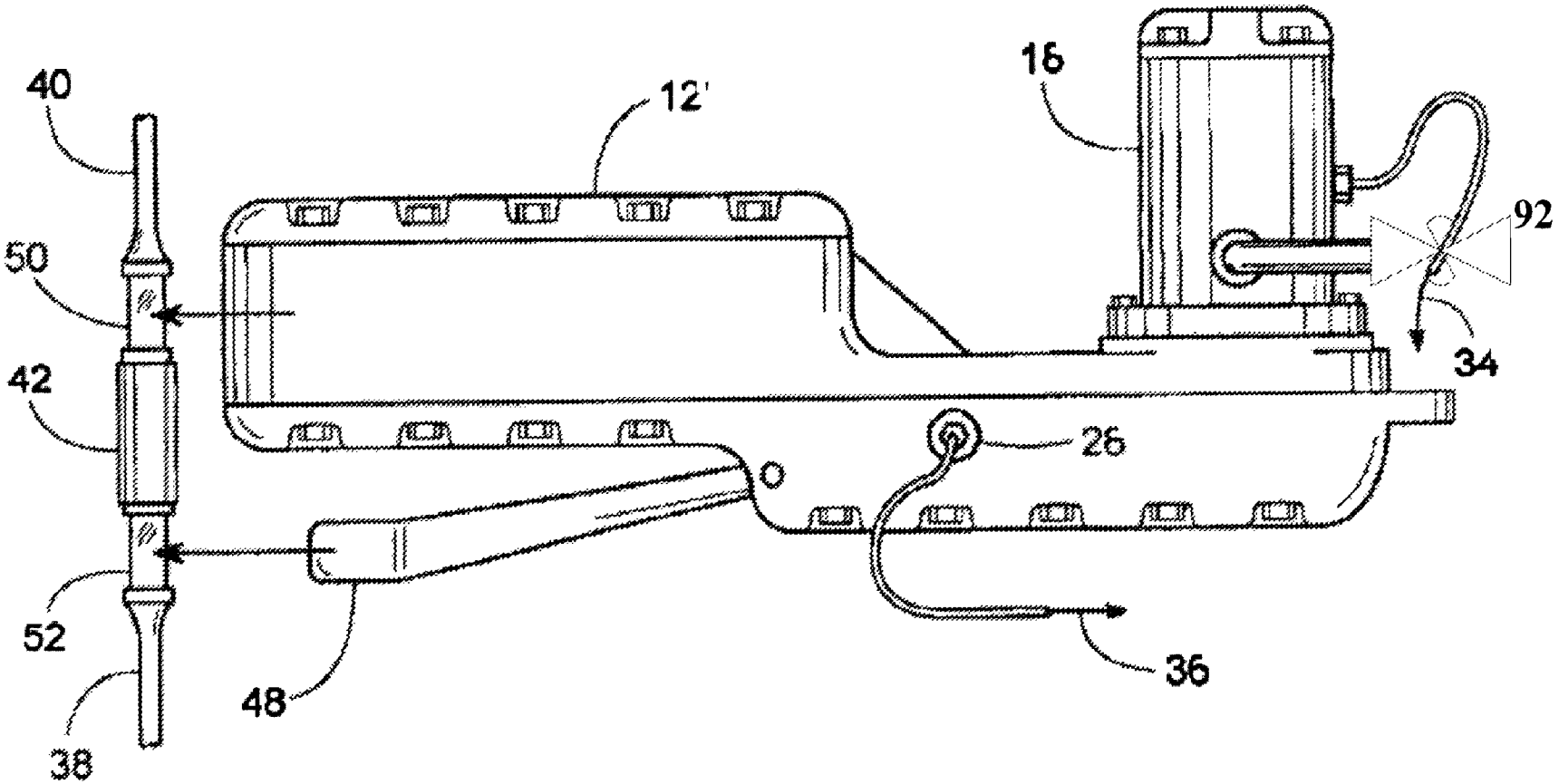
FIG. 1A is a side view of a set of tongs about to tighten two sucker rods into a coupling according to one exemplary embodiment of the present invention.
Figure 1B:
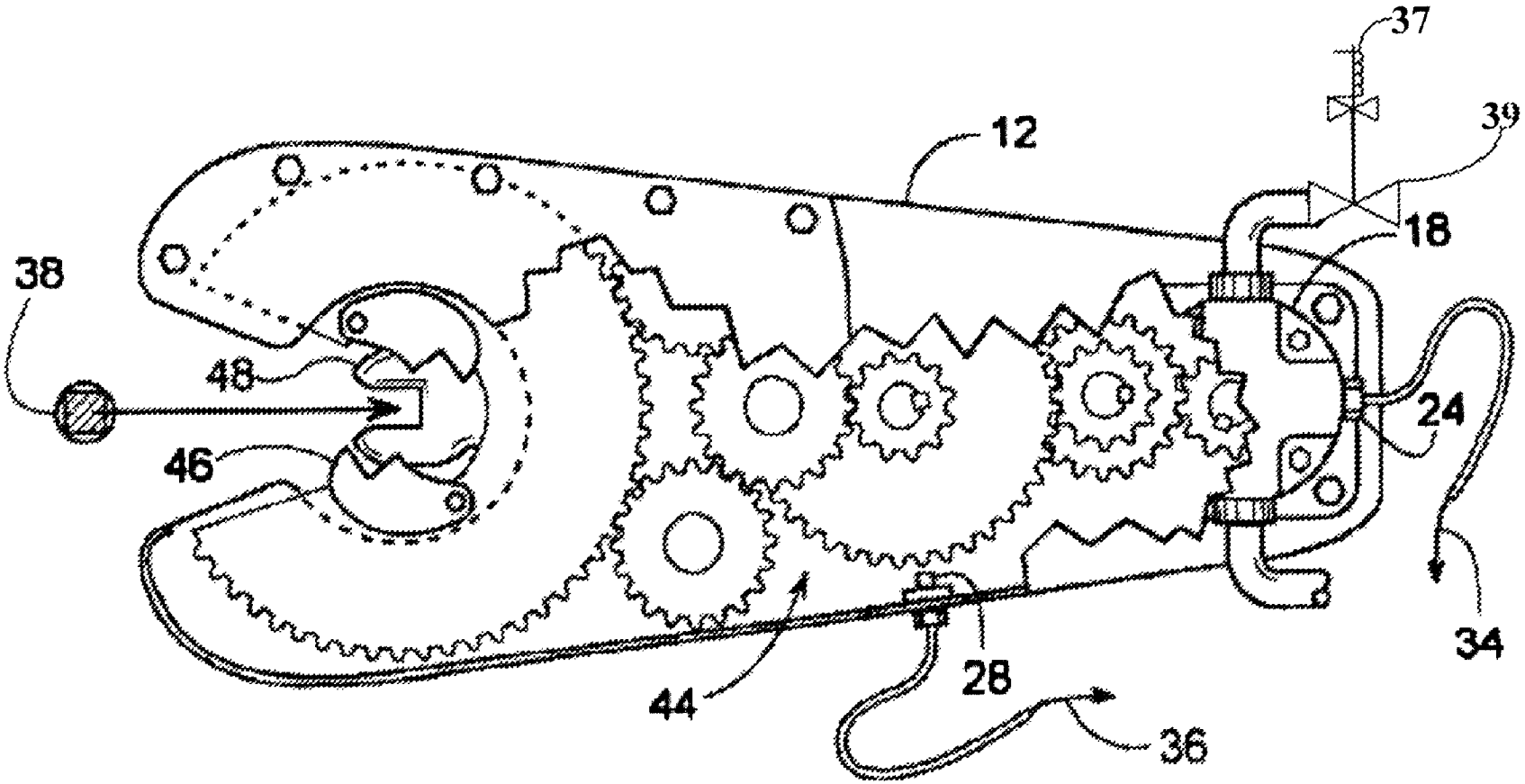
FIG. 1B is a cut-away top view of the tongs according to the exemplary embodiment of FIG. 1A.

Referring now to the drawings, in which like numerals represent like elements throughout the several figures, aspects of the present invention will be described. FIGS. 1, 1A and 1B represent a schematic diagram and other views of a system that monitors a set of tongs tightening a string of elongated members according to one exemplary embodiment of the present invention. Turning now to FIGS. 1, 1A, and 1B, the exemplary system includes a set of tongs 12. The tongs 12 are schematically illustrated to represent various types of tongs including, but not limited to, those used for tightening sucker rods, tubing or casings. In FIG. 1, tongs 12 are shown being used in assembling a string of elongated members 14, which are schematically illustrated to represent any elongated member with threaded ends for interconnecting members 14 with themselves and/or a series of threaded couplings 16. Examples of elongated members 14 include, but are not limited to, sucker rods, tubing, and casings. For ease of reference, the elongated members 14 will be referred to hereinafter as rods; however, no limitation is intended by the use of the term rod.

Tongs 12 include at least one set of jaws 46 and a back-up wrench 48 for gripping and rotating one rod 14 relative to another, thereby screwing at least one rod 14 into an adjacent coupling 16. In one exemplary embodiment, the drive unit 18 is fluidicly coupled to a hydraulic motor and drives the rotation of the jaws 46 gripping the upper rod 40 while the back-up wrench 48 grips the lower rod 38. However, the drive unit 18 is schematically illustrated to represent various types of drive units including those that can move linearly (e.g., piston/cylinder) or rotationally and can be powered hydraulically, pneumatically, or electrically.

In the exemplary embodiment of FIG. 1, the tongs 12 are communicably coupled to an embedded control processor 20, which is communicably coupled to two outputs 21 and four inputs. However, it should be noted that the control processor 20 with fewer inputs/outputs or with inputs other than those used in this example are well within the scope and spirit of the invention. The embedded control processor 20 is schematically illustrated to represent any circuit adapted to receive a signal through an input and respond through an output. Examples of the control processor 20 include, but are not limited to, computers, programmable logic controllers, programmable automation controllers, circuits comprising discrete electrical components, circuits comprising integrated circuits, and various combinations thereof. The embedded control processor 20 can be embedded with the tongs 12 or electrically coupled to the tongs 12 and positioned adjacent to or away from it.

The inputs of the embedded control processor 20, according to some embodiments of the invention, include a first input 22 electrically coupled to a hydraulic pressure sensor 24, a second input 26 electrically coupled to an encoder 28, a third input 41 electrically coupled to the load cell sensor 205 (which is described in greater detail with reference to FIG. 2 below), a PC 11, and a timer 25. In response to the rotational action of the tongs 12, the encoder 28 provides the input signal 36 to the embedded control processor 20 through the second input 26. The term, "rotational action" refers to any rotational movement of any element associated with a set of tongs 12. Examples of such an element include, but are not limited to, gears, jaws, sucker rods, couplings, and tubulars. The term, "tightening action" refers to an effort applied in tightening a threaded connection. In one exemplary embodiment, the encoder 28 is an incremental rotary encoder. This encoder sensor is mounted to the body of the tongs 12 and coupled to the drive mechanism 44 so that it senses rotation in both directions. More specifically, in certain exemplary embodiments, the encoder 28 is a BEI model H25E-F45-SS-2000-ABZC-5V/V-SM12-EX-S. The exemplary encoder 28 generates 2,000 pulses per revolution. The encoder 28 also has a quadrature output, which means 8,000 pulses per revolution can actually be measured. The encoder 28 is mounted in a location which has a drive ratio of 4.833 to the upper jaws 46 holding the sucker rod 14, so 38,666 pulses per rod revolution (or 107 pulses per degree of rod revolution) are generated by the encoder 28.

Since the encoder 28 is mounted directly on the tongs 12, it must have a hazardous area classification. Accordingly, the encoder 28 must be built as an intrinsically safe or explosion proof device to operate in the location of the tongs 12, and monitored through an electronic isolation barrier. The (isolated) encoder pulse signals are measured at the second input 26 by a digital input electronics module, electrically coupled to the embedded control processor 20. As rod speed varies from 0 to 150 revolutions per minute (RPMs), the pulse signals for the encoder 28 vary from 0 to approximately 100,000 pulses per second. To read these high speed pulses accurately, the embedded control processor 20 monitors the digital input signals at 40 MHz frequency. The above measurement using the encoder 28 allows for very precise monitoring of both the position and speed of the rod 14 at all times. In response to the fluid pressure generated by the hydraulic motor that is a part of the tongs drive 18, the hydraulic pressure sensor 24 provides the input signal 34 to the embedded control processor 20.

A personal computer (PC) 11, input device 13, and monitor 23 are also communicably connected to the control processor 20. The input device 13 is communicably connected to the PC 11 and can include a keyboard, mouse, light pen, stencil, or other known input device for a PC or touch pad. The monitor 23 is communicably connected to the PC 11. In one exemplary embodiment, the monitor 23 provides graphic feedback to the operator; however, those of ordinary skill in the art will recognize that the monitor 23 may include, but not be limited to, a CRT, LCD or touch screen display, plotter, printer, or other device for generating graphical representations. The system also includes a timer 25 communicably connected to the control processor 20. In one exemplary embodiment, the timer 25 can be any device that can be employed with a computer, programmable logic controller or other control device to determine the elapsed time from receiving an input. In certain exemplary embodiments, the timer 25 is integral with the control processor 20 or the PC 11.

The exemplary system further includes an alarm device communicably connected to the embedded control processor 20, such that the embedded control processor 20 generates an output 21 to the alarm device. The alarm device is capable of generating an audible alarm in response to the output signal 21 with a speaker, horn, or other noise making device 90. The alarm device is also capable of generating a visual alarm at the alarm panel lights 86, 88.

The system further includes a pulse width modulated (PWM) amplifier module 35 communicably coupled to the control processor 20. The PWM amplifier module 35 is also communicably coupled to an electrical control solenoid valve 37. In one exemplary embodiment, the PWM amplifier module 35 receives a speed set point value from the embedded control processor 20 and outputs a PWM control signal to the electrical control solenoid valve 37 at 12 volts direct current (DC) and 20 KHz PWM frequency. The width of the pulses from the PWM amplifier module 35 to the solenoid valve 37 is modulated from 0-100% duty cycle. In one exemplary embodiment, the solenoid valve 37 has a resistance of approximately seven ohms, so the current varies from 0-170 milliamps (mA), corresponding to the 0-100% duty cycle. The electrical control solenoid valve 37 is communicably connected to a hydraulic spool valve 39. The hydraulic spool valve 39 is fluidicly connected to the hydraulic motor 18. In one exemplary embodiment, the current to the solenoid valve 37 causes changes in the position of the proportional hydraulic spool valve 39. The spool valve 39 changing position varies the flow rate of the hydraulic fluid to the hydraulic motor 18 on the tongs 12.

For illustration, the system will be described with reference to a set of sucker rod tongs 12 used for screwing two sucker rods 38 and 40 into a coupling 42, as shown in FIGS. 1A and 1B. However, it should emphasized that inventive system and methods can be readily used with other types of tongs for tightening other types of elongated members, as discussed above. In this example, a hydraulic motor 18 is the drive unit of the tongs 12. Motor 18 drives the rotation of various gears of a drive train 44, which rotates an upper set of jaws 46 relative to the back-up wrench 48. Upper jaws 46 are adapted to engage flats 50 on sucker rod 40, and the back-up wrench 48 engages the flats 52 on rod 38. So, as the upper jaws 46 rotate relative to the back-up wrench 48, the upper sucker rod 40 rotates relative to lower sucker rod 38, which forces both rods 38 and 40 to tightly screw into the coupling 42.

As discussed above, in the example of FIGS. 1A and 1B, sensor 24 is a conventional hydraulic pressure sensor in fluid communication with motor 18 to sense the hydraulic pressure that drives the motor 18. Generally speaking, with reference to the limitations described above regarding the problems of inferring the relationship between pressure and torque, an increase in the hydraulic pressure from the motor 18 will typically increase the amount of torque exerted by the tongs 12 (all other variables being the same), so the load cell sensor 505 provides an input signal 41 corresponding to a torque level. In certain exemplary embodiments, the hydraulic supply to the motor 18 also includes a pressure relief valve 92. The pressure relief valve 92 limits the pressure that is applied across the motor 18, thus helping to limit the extent to which a connection is tightened. In one exemplary embodiment, the pressure relief valve 92 is adjustable by known adjustment means to be able to vary the amount of hydraulic pressure based on rods and tubes of varying diameters and grades.

Figure 2:
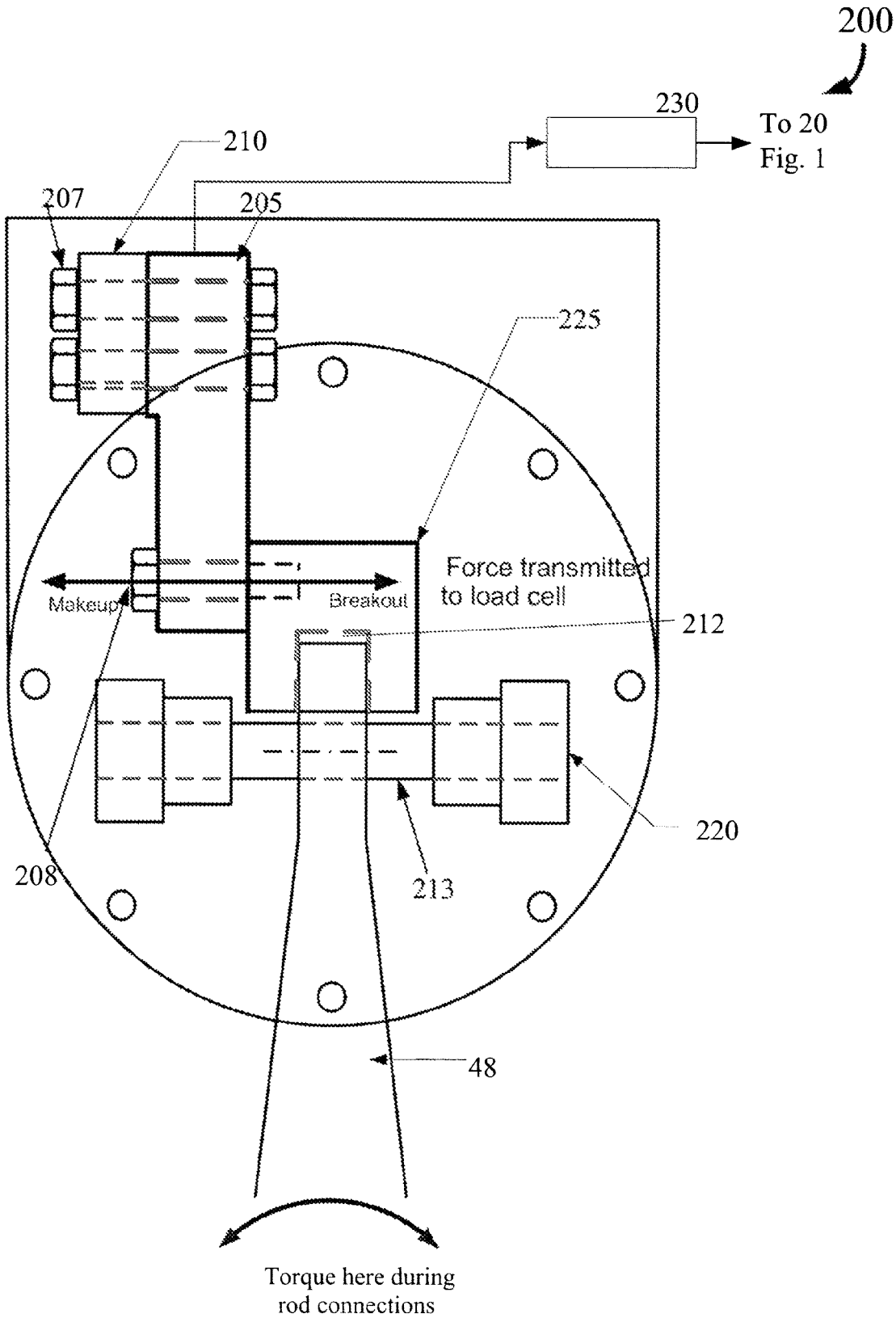
FIG. 2 is an exemplary representation of a cut-away schematic diagram of an alternative tongs system that includes a load cell for measuring torque in accordance with one exemplary embodiment of the present invention.

FIG. 2 is an exemplary representation of a tongs system 200 that includes a load cell for measuring torque incorporated into the tongs 12 of FIG. 1B in accordance with one exemplary embodiment of the present invention. Referring now to FIGS. 1, 1A, 1B and 2, the exemplary system 200 includes a load cell 205 coupled along one end to a mounting block 210 using known coupling means 207 including, but not limited to, bolts and nuts. The load cell 205 is typically positioned adjacent the back-up wrench 48. The load cell 205 is coupled along an opposing end to a receiver block 225 using known coupling means 208 including, but not limited to, bolts and nuts. The receiver block 225 constrains the rear end of the back-up wrench so that force is transmitted into the load cell 205. In one exemplary embodiment, the load cell 205 is a SENSOTEC model 103 2000 kilogram load cell. However, other types of load sensors known to those of ordinary skill in the art could be used and are within the scope and spirit of this invention.

The system 200 further includes a back-up wrench 48 making contact on a first end 212 with the receiver block 225 and receiving a torque along a second end 48 during rod make-up or breakout. The back-up wrench 48 is held in position against the receiver block by a pair of mounting blocks 220 and a retainer pin 213.

In practice, the tongs 12 has a rotating upper jaw 46, driven by the hydraulic motor 18 that turns the flats 50 on the upper rod 40. The flats 52 of the lower rod 38 in the connection are held in the back-up wrench 48. This back-up wrench 48 is held loosely in position using the spring mounted pin 213, so that it can easily be changed as required to fit differing size rods 14. When torque is applied to the rod connection, the resulting moment causes the back-up wrench 48 to turn slightly. In conventional tongs the far end of the back-up wrench comes to rest against a stop which is built into the body of the tongs. This reaction point is what has been adapted to monitor the resulting force with the load cell 205. As the rod 38 receives torque during a make-up or breakout, the back-up wrench 48 is moved at its second end 48, causing an opposing movement in the first end 212 of the back-up wrench 48. Movement of the first end 212 of the back-up wrench 48 causes a corresponding force in the receiver block 225. Since the load cell 205 is coupled to the receiver block 225 by way of the bolt 208, the corresponding force in the receiver block 225 is sensed by the load cell 205. The control processor 20 is able to calculate the corresponding torque based on the input signal 41 from the load cell sensor 505. In one exemplary embodiment, the calculation is accomplished by previously placing a calibration sensor on the tongs and applying one or more known torques to the calibration sensor. The known torques are compared to the voltage signal outputs for the load cell 505 and scaling is applied to the load cell signal to covert voltage output into foot-pounds of torque.

In one exemplary embodiment, the expected torque generated on make-up is up to 2,000 ft-lb, with breakout torques being even higher, up to 3,000 ft-lb. This generates loads in the load cell 205 up to 3,000 lb. The torque signal from the load cell 205 is sampled by an digital input module 230 communicably coupled to the embedded control processor 20. In certain exemplary embodiments, the digital input module 230 samples the load cell two ways—first by time, and second triggered by every pulse from the encoder 28. This gives an improved calculation of the connection torque as a function of both time and rod position. In one exemplary embodiment, time-based scanning occurs at a rate of 10,000 samples per second, and the position pulses result in torque data measured between 0 and 100,000 samples per second.

Processes of exemplary embodiments of the present invention will now be discussed with reference to FIGS. 3-6. Certain steps in the processes described below must naturally precede others for the present invention to function as described. However, the present invention is not limited to the order of the steps described if such order or sequence does not alter the functionality of the present invention in an undesirable manner. That is, it is recognized that some steps may be performed before or after other steps or in parallel with other steps without departing from the scope and spirit of the present invention. As an initial note, while the exemplary embodiments of FIGS. 3-6 are described with reference to an evaluation of a set of tongs, whether they be rod tongs, tubing tongs, casing tongs or any other set of tongs, the methods disclosed herein could also be used to evaluate the efficiency and operational health of many other hydraulically driven devices and systems and could be evaluated to modify the timing of commands based on hydraulic oil temperatures and ambient temperatures in many other devices including, but not limited to, hydraulic top drives, hydraulic power swivels, hoist drives, and other hydraulically, electrically and pneumatically driven systems both in and outside of the well service industry. In the exemplary embodiment involving tubing tongs, the tubing tongs provide a rotational force on a tubing string made up of tubing. In the exemplary embodiment involving casing tongs, the casing tongs provide a rotational force on a casing string made up of casings. In the exemplary embodiment involving a top drive, the top drive provides a rotational force on a drill string made up of drilling pipe during a drilling operation. In the exemplary embodiment involving a power swivel, the power swivel provides a rotational force on a drill string made up of drilling pipe during a drilling operation. Each of the exemplary top drive and the power swivel are provided power by a hydraulically driven system similar to that described with reference to and driving the tongs 12.

Figure 3:
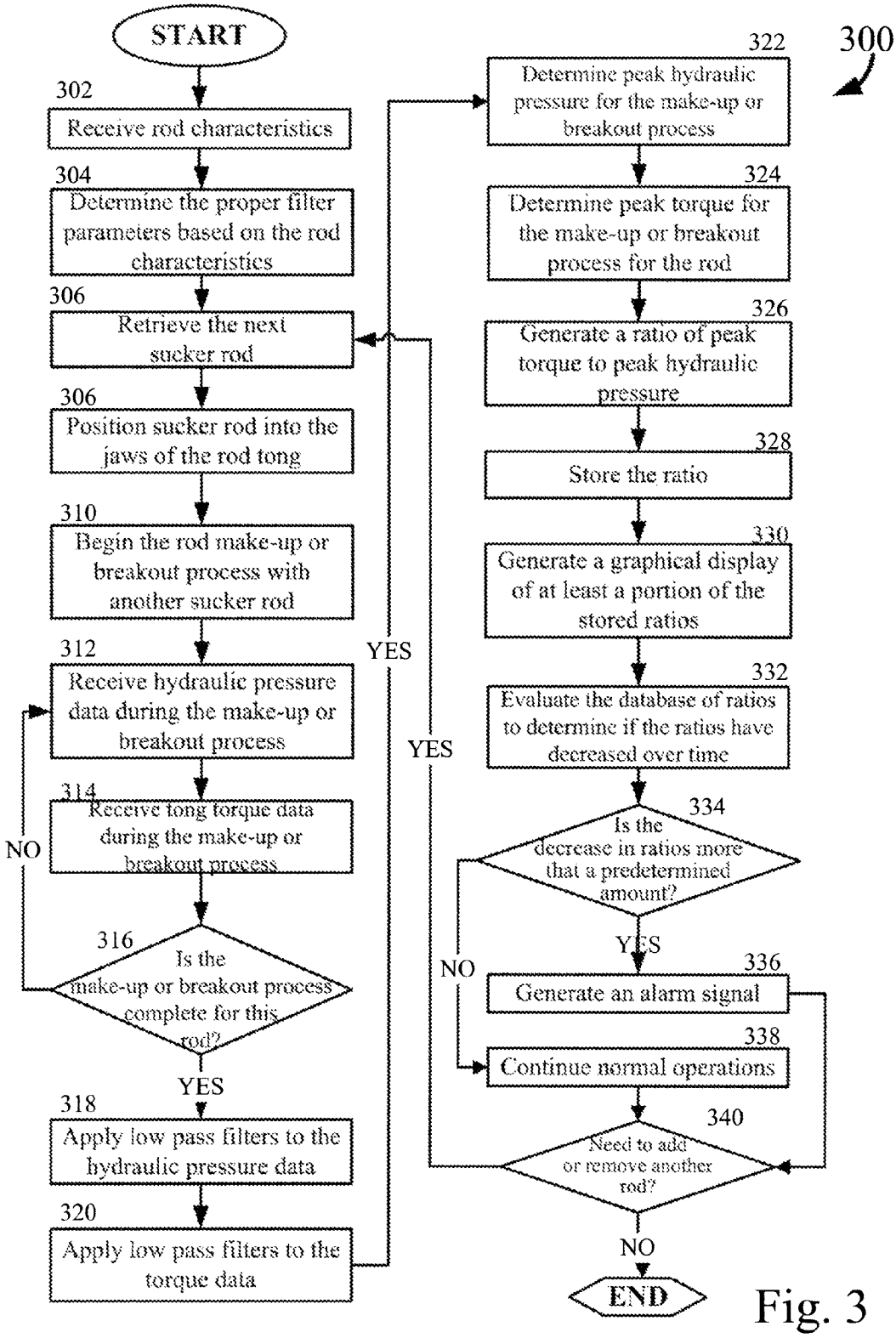
FIG. 3 is a flowchart of an exemplary process for receiving and evaluating data to determine the efficiency of a tongs system by comparing the energy input versus the energy output in accordance with one exemplary embodiment of the present invention.

Turning now to FIG. 3, an exemplary process 300 for receiving and evaluating data to determine the efficiency of a tongs system by comparing the energy input versus the energy output as well as evaluating the operational health of the tongs system based on an evaluation of the change in a ratio of energy input to energy output is shown and described within the exemplary operating environment of FIGS. 1, 1A, 1B, and 2. Referring now to FIGS. 1, 1A, 1B, 2, and 3, the exemplary method 300 begins at the START step and proceeds to step 302, where the rod characteristics are input into the input device 13 and received at the PC 11. In one exemplary embodiment, the rod characteristics include, but are not limited to, rod manufacturer, rod grade, rod size, single or double coupling, single, double, or triple rod string, number of threads on a rod end, and whether the rod is new or rerun condition.

In step 304, the PC 11 determines the proper filter parameters based on the rod 40 and/or tongs 12 characteristics. In one exemplary embodiment, the PC 11 uses a software program and a database of information to determine which filter parameters should be used. In one exemplary embodiment, multiple filter parameters could be used as part of the evaluation. The next sucker rod 40 is retrieved for coupling in step 306 using known methods and means. In step 308, the sucker rod 40 is positioned into the upper set of jaws 46 on the tongs 12. The rod make-up or breakout process begins in step 310 by attaching one rod 40 to another rod 38 with the use of a coupling 42.

In step 312, hydraulic pressure data is received during the make-up or breakout process at the hydraulic pressure sensor 24 and a signal 34 is transmitted to the first input 22. Those of ordinary skill in the art will recognize that other methods and types of sensors exist for determining hydraulic pressure being input into a hydraulic motor. Each of these known methods and sensor types are within the scope and spirit of the present invention. Once received, the hydraulic pressure signal is transmitted from the first input 22 to the embedded control processor 20, which can subsequently transmit the hydraulic pressure data to the PC 11. The hydraulic pressure data represents the hydraulic fluid pressure that is the input energy to the hydraulic tongs motor 18. The tongs torque data is received during the make-up or breakout process at the load cell 205 in step 314. Those of ordinary skill in the art will recognize that other methods and types of sensors exist for determining the torque being applied by the tongs 12 to the rod 40. Each of these known methods and sensor types are within the scope and spirit of the present invention. Once received, the tongs torque data is transmitted from the load cell 205 to the embedded control processor 20 and from there transmitted to the PC 11.

In step 316, an inquiry is conducted to determine if the make-up or breakout process for the rod 40 is complete. If the make-up or breakout process is not complete, the NO branch is followed back to step 312 to receive additional hydraulic pressure and torque data. If the make-up or breakout process is complete, the YES branch is followed to step 318, where the PC 11 applies low pass filters to the hydraulic pressure data and the torque data and then determines the peak readings. In certain exemplary embodiments, determining the "peak" reading for each connection requires some filtering of the signals. Since sampling rates are so high, each individual reading of torque or pressure is not so meaningful in this context. Low pass filers are applied to the data in software residing or usable by the PC 11 to determine the true peak readings during the make-up or breakout process. In one exemplary embodiment, filter parameters vary as a function of connection speed, which varies by rod characteristics, such as rod manufacturer, rod grade, and/or rod size.

Sampling rates vary from 10,000 samples per second to 100,000 samples per second on the analog input signals from the hydraulic pressure sensor 24 and the load cell 205. Connection speeds vary from 20 to 40 revolutions per minute (RPMs). In one exemplary embodiment, the low pass filter parameters are $2^{nd}$ order Butterworth filters, with cutoff frequencies from 10 to 1,000 Hz.

In other exemplary embodiments, analysis of the peak values at multiple different filter frequencies can be done to determine if spikes are present in the signals, which could be due to thread defects, face damage, or problems in the hydraulics, or drive system 44. If the signal is sufficiently smooth, the peak readings will be consistent for all filter frequencies. If there is high speed (high frequency) content in the signals, the peak values will decrease as filter frequencies are lowered. Generally, if this happens on one connection, it is probably in the connection itself. If it happens consistently, or grows in amplitude as time goes by, then the tongs equipment is likely the cause. In both cases, alarms are generated as discussed below to allow remediation by the operator.

In step 320, the PC 11 applies low pass filters to the torque data. The PC determines the peak hydraulic pressure for the make-up or breakout process in step 322 and the peak torque for the make-up or breakout process in step 324. The PC 11 generates a ratio of peak torque (output of the tongs 12) to peak hydraulic pressure (input to the tongs drive 18) for the make-up or breakout process of the rod 40 in step 326. The ratio is stored in step 328. In one exemplary embodiment, the PC 11 stores the ratio in a database (not shown) and each database entry includes an associated time entry designating the time at which the data was received, the ratio was determined, or the ratio was stored. In one exemplary embodiment, the ratio is stored in a hard drive or other fixed or transportable data storage device at the PC 11. The data storage devices include, but are not limited to, floppy disks, compact discs, digital versatile disc (DVD), universal serial bus (USB) flash drives, or memory cards. Alternatively, or in addition to the storage of the ratio at the PC 11, the ratio is transmitted to a location remote from the tongs and stored electronically at the remote location. U.S. Pat. Nos. 6,079,490 and 7,006,920 describe exemplary systems and methods for transmitting well-service data to a location remote from a well, including the use of satellite, cellular, and internet-based technology. The information in those patents is incorporated herein by reference.

In step 330, a graphical display of the current and at least a portion of the prior ratios for the tongs 12 is generated on the monitor 23. In step 332, the current and historical set of ratios that have been stored for the tongs 12 is evaluated to determine if the ratios have decreased over time. In step 334, an inquiry is conducted to determine if the ratio has decreased more than a predetermined amount. As stated above, in even the best tongs equipment, the ratio will decrease over time as wear and other losses occur. A predetermined value representing the amount of decrease in the ratio is stored in the PC 11 and compared by it to the actual change in the ratio based on an evaluation of the current ratio to historical ratios stored in the database. In one exemplary embodiment, the predetermined amount ranges from 0-90 percent decrease as compared to the historical ratio. If the ratio has decreased more than a predetermined amount, the YES branch is followed to step 336, where an alarm signal is generated. In one exemplary embodiment, the alarm signal is generated by the embedded control processor 20 or the PC 11. The alarm signal may generate an audible or visual alarm that may occur at the speaker 90, panel lights 86, 88, or the monitor 23. The process continues from step 336 to step 340.

Returning to step 334, if the ratio has not decreased more than a predetermined amount, the NO branch is followed to step 338, where the tongs system continues normal operations. In step 340, an inquiry is conducted to determine if additional rods 14 still need to be added to the rod string. In one exemplary embodiment, this determination is made by either the PC 11, the operator, or another person or device. If another rod 14 needs to be added to the rod string, then the YES branch is followed back to step 306, to retrieve the next sucker rod 14. On the other hand, if the rod string had been completed, the NO branch is followed to the END step.

Figure 4:
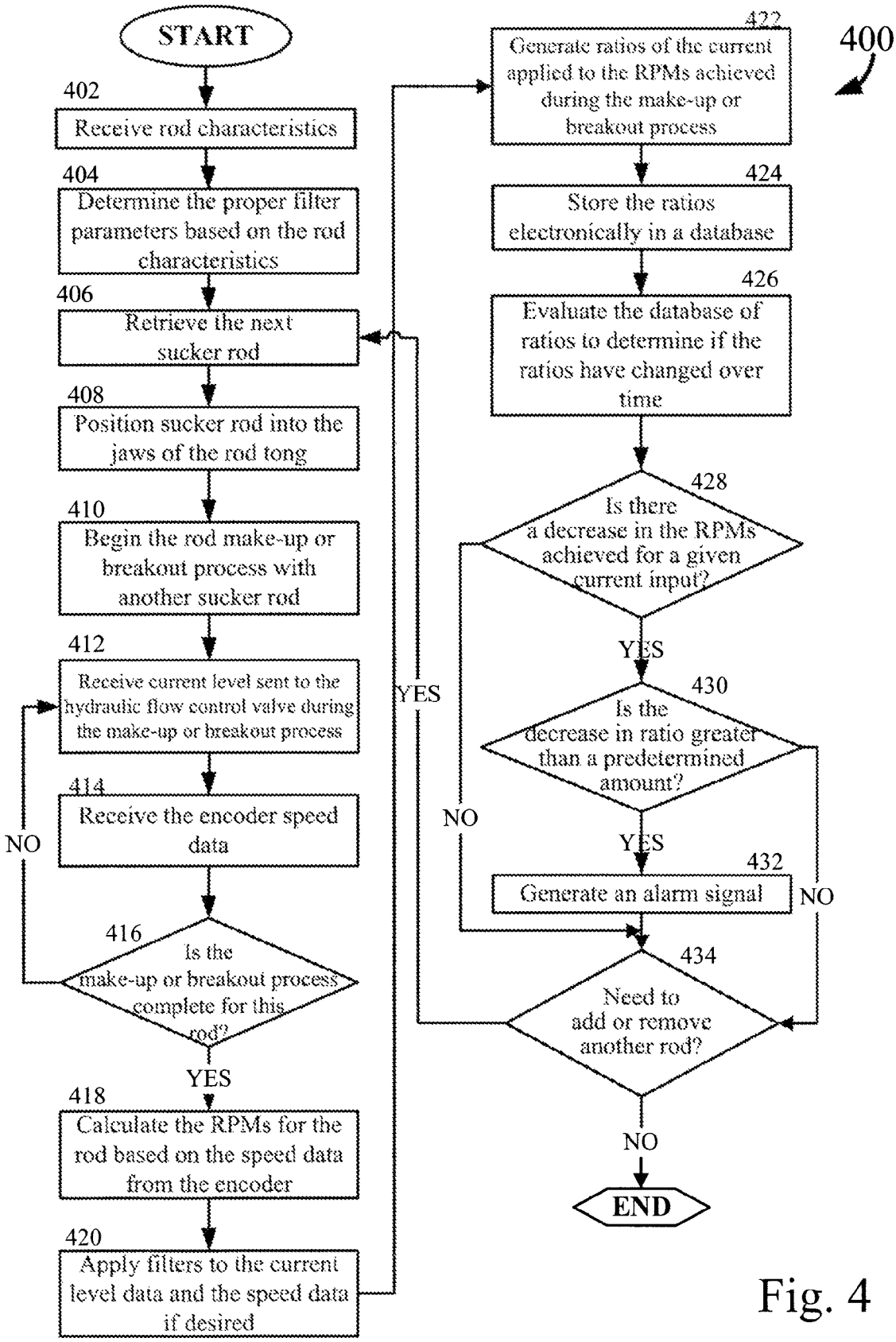
FIG. 4 is a flowchart of an exemplary process for receiving and evaluating data to determine the operational health of a tongs drive by comparing current levels transmitted to the solenoid valves of the tongs drive to the speed generated by the tongs drive in accordance with one exemplary embodiment of the present invention.

Turning now to FIG. 4, an exemplary process 400 for receiving and evaluating data to determine the operation health of a tongs drive 18 by comparing current levels transmitted to the solenoid valves 37 of the tongs drive 18 to the speed generated by the tongs drive 18 is shown and described within the exemplary operating environment of FIGS. 1, 1A, 1B, and 2. Now referring to FIGS. 1, 1A, 1B, 2, and 4, the exemplary method 400 begins at the START step and proceeds to step 402, where the rod characteristics are input into the input device 13 and received at the PC 11. In one exemplary embodiment, the rod characteristics include, but are not limited to, rod manufacturer, rod grade, rod size, single or double coupling, single, double, or triple rod string, the number of threads on each rod end, and whether the rod is new or used.

In step 404, the PC 11 determines the proper filter parameters based on the rod 40 and/or tongs 12 characteristics. In one exemplary embodiment, the PC 11 uses a software program and a database of information to determine which filter parameters should be used. In one exemplary embodiment, multiple filter parameters could be used as part of the evaluation. The next sucker rod 40 is retrieved for coupling in step 406 using known methods and means. In step 408, the sucker rod 40 is positioned into the upper set of jaws 46 on the tongs 12. The rod make-up or breakout process begins in step 410 by attaching one rod 40 to another rod 38 with the use of a coupling 42.

In step 412, the current levels that are being transmitted to the electrical control solenoid valve 37 are received during the make-up or breakout process at the PWM amplifier module 35, or at the embedded control processor 20 and subsequently transmitted to the PC 11. The current data represents the PWM control signal transmitted to the electrical control solenoid valve 37 to generate a change in position of the hydraulic spool valve 39, which generates a corresponding change in the flow-rate of the hydraulic fluid to the hydraulic motor 18.

The encoder speed data is received during the make-up or breakout process at the encoder 28 in step 414. Those of ordinary skill in the art will recognize that other methods and types of sensors exist for determining the speed generated on the rod 40 by the tongs 12. Each of these known methods and sensor types are within the scope and spirit of the present invention. Once received, the speed data is transmitted from the encoder 28 to the embedded control processor 20, and from there transmitted to the PC 11.

In step 416, an inquiry is conducted to determine if the make-up or breakout process for the rod 40 is complete. If the make-up or breakout process is not complete, the NO branch is followed back to step 412 to receive additional current and speed data. If the make-up or breakout process is complete, the YES branch is followed to step 418, where the PC 11 calculates the revolutions per minute that the rod 40 is turning based on the speed data from the encoder 28. Filters can be applied to the current level data and the speed data in a manner substantially similar to that as described above with reference to FIG. 3, if desired in step 420. In step 422, the PC 11 generates ratios of the current applied to the electrical control solenoid valve 37 and the RPMs generated on the rod 40 in response to that current level. The PC 11 stores the ratios electronically in a database in step 424. In one exemplary embodiment, the ratios are stored in a database and each database entry includes an associated time entry designating the time at which the data was received, the ratio was determined, or the ratio was stored. In one exemplary embodiment, the ratio is stored in a hard drive or other fixed or transportable data storage device at the PC 11.

Examples of data storage devices include, but are not limited to, floppy disks, compact discs, DVDs, USB flash drives, or memory cards. Alternatively, or in addition to the storage of the ratio at the PC 11, the ratio is transmitted to a location remote from the tongs and stored electronically at the remote location in a manner such as that taught in U.S. Pat. Nos. 6,079,490 and 7,006,920, which describe exemplary systems and methods for transmitting well-service data to a location remote from a well, wherein transmission includes the use of satellite, cellular, and/or internet-based technology. In addition, a graphical display of current and historical ratios may be generated by the PC 11 and displayed on the monitor 23.

In step 426, the current and historical set of ratios that have been stored for the tongs 12 is evaluated to determine if the ratios have changed over time. In step 428, an inquiry is conducted to determine if there has been a decrease in the RPMs achieved for a given current output to the electrical coil solenoid (i.e. a decrease in the ratio of RPMs to current level). In certain exemplary embodiments, a decrease in RPM for a given command signal (current level sent to the electrical control solenoid valve 37) is due to wear in the hydraulic motor 18 caused by hydraulic leakage, wear, increased mechanical friction in the tongs drive or lower viscosity hydraulic fluid. Generally, the control current varies from 0-150 mA to the solenoid valve 37. The rotational speed varies from 0-150 RPMs. Very slight variations typically occur due to rod size, rod string, and even wind loading. However, these types of variations are not systematic. In one exemplary embodiment, the changes being monitored in FIG. 4 occur over hundreds of connections and several days of operation. If there has not been a decrease, the NO branch is followed to step 434. Otherwise, the YES branch is followed to step 430.

In step 430, an inquiry is conducted at the PC 11 to determine if the ratio has decreased more than a predetermined amount. A predetermined value representing the amount of decrease in the ratio is stored in the PC 11 and compared by it to the actual change in the ratio based on an evaluation of the current ratio to historical ratios stored in the database or other data storage device. In one exemplary embodiment, the predetermined amount ranges from 0-90 percent decrease as compared to the historical ratio. If the ratio has decreased more than a predetermined amount, the YES branch is followed to step 432, where an alarm signal is generated. In one exemplary embodiment, the alarm signal is generated by the embedded control processor 20 or the PC 11. The alarm signal generates an audible or visual alarm that may occur at the speaker 90, panel lights 86, 88, or the monitor 23. The process continues from step 432 to step 434.

Returning to step 430, if the ratio has not decreased more than a predetermined amount, the NO branch is followed to step 434. In step 434, an inquiry is conducted to determine if additional rods 14 still need to be added to the rod string. In one exemplary embodiment, this determination is made by either the PC 11, the operator, or another person or device. If another rod 14 needs to be added to the rod string, then the YES branch is followed back to step 406 to retrieve the next sucker rod 14. On the other hand, if the rod string had been completed, the NO branch is followed to the END step.

In an alternative embodiment, the process of FIG. 4 is modified to substitute hydraulic pressure data for speed data throughout the process, wherein the hydraulic pressure data points comprise a hydraulic pressure sensed by the hydraulic pressure sensor 24 for a hydraulic drive or torque generated on the elongated member by the hydraulically driven system. In this process, a ratio is generated comparing current level to pressure achieved at the current level.

Figure 5:
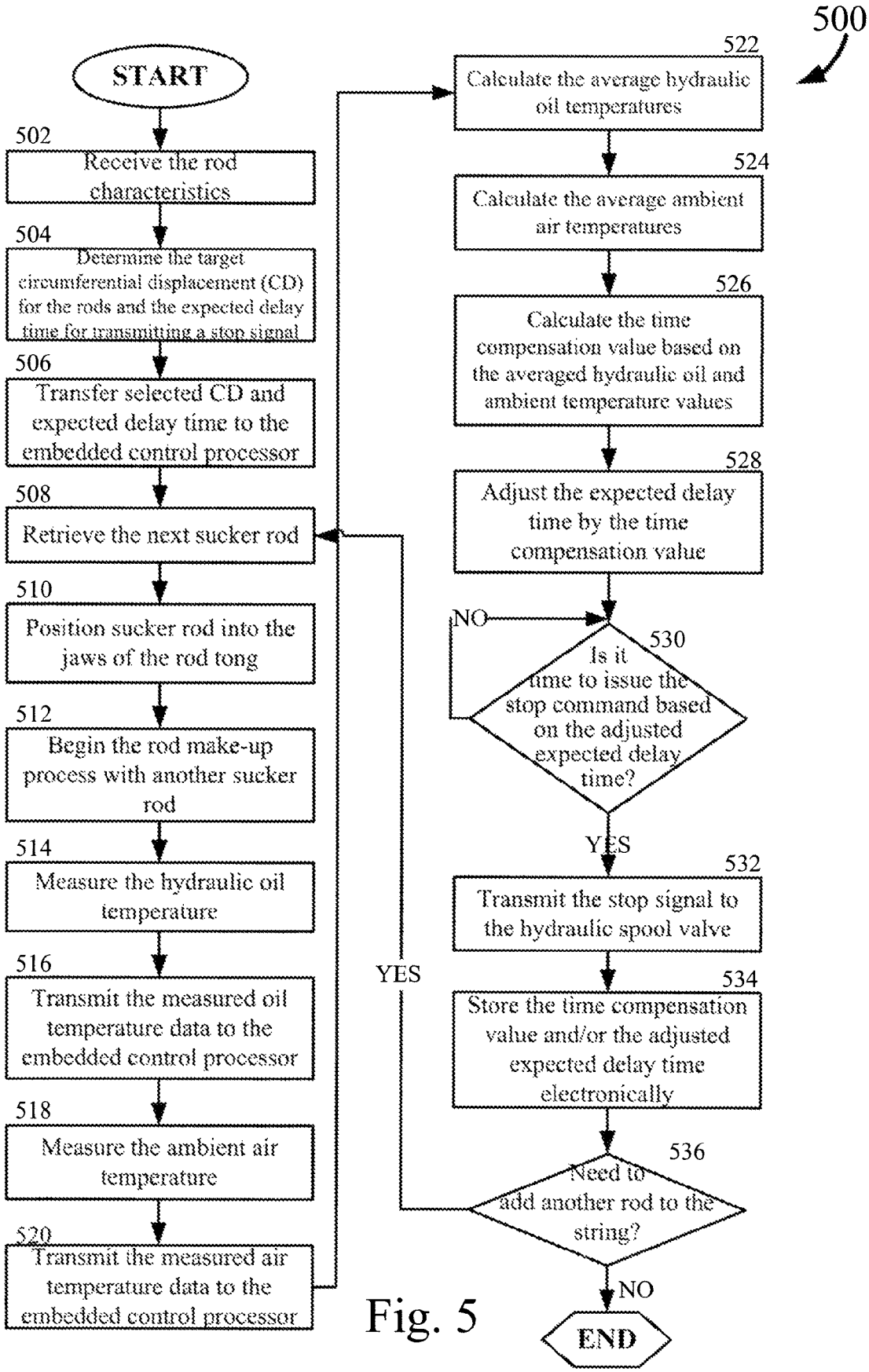
FIG. 5 is a flowchart of an exemplary process for evaluating temperature variables and adjusting system timing for the tongs drive based on those temperature variables in accordance with one exemplary embodiment of the present invention.

FIG. 5 is a flowchart of an exemplary process 500 for evaluating temperature variables and adjusting system timing parameters for the tongs drive 18 based on the temperature variables within the exemplary operating environment of FIGS. 1, 1A, 1B, and 2. Referring now to FIGS. 1, 1A, 1B, 2, and 5, the exemplary method 500 begins at the START step and proceeds to step 502, where the rod characteristics are input into the input device 13 and received at the PC 11. In one exemplary embodiment, the rod characteristics include, but are not limited to, rod manufacturer, rod grade, rod size, single or double coupling, single, double, or triple rod string, the number of threads on each rod end, and whether the rod is new or used. In step 504, the PC 11 determines the target circumferential displacement (CD) of the rod during make-up and the expected delay time for transmitting the stop signal based on the rod characteristics. In one exemplary embodiment, the PC 11 uses a software program and a database of information to determine the target CD and expected delay time. The PC 11 transfers the target CD and expected delay time to the embedded control processor 20 in step 506.

The next sucker rod 40 is retrieved for coupling in step 508 using known methods and means. In step 510, the sucker rod 40 is positioned into the upper set of jaws 46 on the tongs 12. The rod make-up process begins in step 512 by attaching one rod 40 to another rod 38 with the use of a coupling 42. In step 514, the temperature of the hydraulic oil driving the hydraulic motor 18 is measured. In one exemplary embodiment, the hydraulic oil temperature is measured by an analog input module communicably coupled to the embedded control processor 20 at a rate of ten samples per second. However, other types of known temperature sensors and other sampling rates between less than 1 and 1000 samples per second are within the scope and spirit of the invention. The hydraulic oil temperature data is transmitted from the analog input module to the embedded control processor 20 in step 516.

In step 518, the ambient air temperature is measured. In one exemplary embodiment, ambient air temperature is measured by an analog input module communicably connected to the embedded control processor at a rate of ten samples per second. However, other types of known temperature sensors and other sampling rates, including rates between less than 1-1000 samples per second are within the scope and spirit of the present invention. The ambient air temperature data is transmitted from the analog input module to the embedded control processor 20 in step 520.

In step 522, the embedded control processor 20 calculates averages for the hydraulic oil temperatures. In one exemplary embodiment, the calculation is an average of each set of ten hydraulic oil temperature data points. Averaging the hydraulic oil temperature data points improves stability and accuracy of the data. In step 524, the embedded control processor 20 calculates averages for the ambient air temperature. In one exemplary embodiment, the calculation is an average of each set of ten ambient air temperature data points. As with the hydraulic oil temperatures, averaging the ambient air temperature data points improves stability and accuracy of the data.

The embedded control processor 20 calculates the time compensation value based on the averaged hydraulic oil and ambient air temperature values in step 526. In one exemplary embodiment, the embedded control processor 20 includes a software algorithm that calculates the amount of compensation that is required to account for the averaged temperatures. In step 528, the embedded control processor 20 adjusts the expected delay time by the time compensation value by adding or subtracting the time compensation value from the expected delay time. In step 530, an inquiry is conducted to determine if it is time to issue the stop command based on the adjusted expected delay time. If not, the NO branch is followed back to step 530 to await the time to issue the stop command. If it is time to issue the stop command, the YES branch is followed to step 532, where the embedded control processor 20 transmits the stop signal to the hydraulic spool valve 39.

The time compensation value and/or the adjusted expected delay time is stored electronically in step 534. In one exemplary embodiment, the time compensation value and/or the adjusted expected delay time are stored in a hard drive or other fixed or transportable data storage device at the PC 11. Examples of data storage devices include, but are not limited to, floppy disks, compact discs, DVDs, USB flash drives, or memory cards. Alternatively, or in addition to the storage of the ratio at the PC 11, the time compensation value and/or the adjusted expected delay time is transmitted to a location remote from the tongs and stored electronically at the remote location in a manner such as that taught in U.S. Pat. Nos. 6,079,490 and 7,006,920, which describe exemplary systems and methods for transmitting well-service data to a location remote from a well, wherein transmission includes the use of satellite, cellular, and/or Internet-based technology.

In step 536, an inquiry is conducted to determine if additional rods 14 still need to be added to the rod string. In one exemplary embodiment, this determination is made by either the PC 11, the operator, or another person or device. If another rod 14 needs to be added to the rod string, then the YES branch is followed back to step 508, to retrieve the next sucker rod.

On the other hand, if the rod string had been completed, the NO branch is followed to the END step.

Although the invention is described with reference to preferred embodiments, it should be appreciated by those skilled in the art that various modifications are well within the scope of the invention. From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the exemplary embodiments, equivalents of the elements shown therein will suggest themselves to those skilled in the art, and ways of constructing other embodiments of the present invention will suggest themselves to practitioners of the art. Therefore, the scope of the present invention is not limited herein.

We claim:

1. A method for modifying the time delay of a stop signal for a set of tongs during a make-up process, comprising;

accepting an expected delay time for transmitting the stop signal;

receiving at a processor at least one hydraulic oil temperature data point;

receiving at the processor at least one ambient air temperature data point;

calculating with the processor a time compensation value based on the hydraulic oil temperature data point and the ambient air temperature data point; and modifying with the processor the expected delay time by the time compensation value.

2. The method of claim 1, wherein a plurality of hydraulic oil temperature data points and a plurality of ambient air temperature data points are received and wherein the process further comprises:

calculating with the processor an average hydraulic oil temperature;

calculating with the processor an average ambient air temperature; and wherein calculating the time compensation value is based on the average hydraulic oil temperature and the average ambient air temperature.

3. The method of claim 2, wherein the average hydraulic oil temperature is calculated based on the ten most recent hydraulic oil temperature data points and wherein the average ambient air temperature is calculated based on the ten most recent ambient air temperature data points.

4. The method of claim 1, further comprising the steps of:

receiving at an input device at least one characteristic associated with a rod used in the make-up process;

transmitting the rod characteristic to the processor; and determining with the processor the expected delay time based at least in part on the rod characteristic.

5. The method of claim 1, wherein the hydraulic oil temperature data point and the ambient air temperature data point are collected by an analog input module.

6. The method of claim 1, further comprising storing the modified expected time delay in a data storage device.

7. A method for modifying the time delay of a stop signal for a set of tongs during a sucker rod make-up process, comprising;

receiving at least one characteristic associated with a sucker rod used in the make-up process;

determining at a processor an expected delay time for transmitting the stop signal for the set of tongs based on at least one characteristic associated with the sucker rod;

coupling the sucker rod to at least one other sucker rod in the make-up process;

taking a plurality of hydraulic oil temperature measurements during the make-up process;

calculating with the processor a time compensation value based on the plurality of hydraulic oil temperature measurements; and modifying with the processor the expected delay time by the time compensation value.

8. The method of claim 7, wherein taking a plurality of hydraulic oil temperature data points further comprises:

calculating with the processor an average hydraulic oil temperature based on the plurality of hydraulic oil temperature measurements taken;

wherein calculating the time compensation value is based on the average hydraulic oil temperature.

9. The method of claim 8, wherein the average hydraulic oil temperature is calculated based on the ten most recent hydraulic oil temperature data measurements taken.

10. The method of claim 7, further comprising the step of taking a plurality of ambient air temperature measurements during the make-up process.

11. The method of claim 10, wherein calculating the time compensation value is based on the plurality of hydraulic oil temperature measurements and the plurality of ambient air temperature measurements.

12. The method of claim 11, wherein taking a plurality of ambient air temperature measurements further comprises calculating with the processor an average of the ambient air temperature measurements taken wherein calculating the time compensation value is based on an average hydraulic oil temperature and the average ambient air temperature measurements taken.

13. The method of claim 7, further comprising the step of determining a target circumferential displacement for the sucker rod during the make-up process based on the at least one characteristic associated with the sucker rod.

14. The method of claim 7, wherein the hydraulic oil temperature measurements are taken from hydraulic oil used in a hydraulic motor driving at least one jaw of the tongs.

* * * * *